United States Patent [19]

Nakamura

[11] 4,281,575

[45] Aug. 4, 1981

[54] TOY INCLUDING A MUSIC PLAYING DEVICE THEREIN

[75] Inventor: Yoshifumi Nakamura, Numazu, Japan

[73] Assignee: Nanbu Industrial Co., Ltd., Numazu, Japan

[21] Appl. No.: 47,327

[22] Filed: Jun. 11, 1979

[30] Foreign Application Priority Data

| | | | |
|---|---|---|---|
| Jun. 14, 1978 | [JP] | Japan | 53/81561[U] |
| Mar. 2, 1979 | [JP] | Japan | 54/26371[U] |
| Mar. 5, 1979 | [JP] | Japan | 54/26704[U] |

[51] Int. Cl.[3] ..... G10H 3/03

[52] U.S. Cl. ..... 84/1.28; 84/95 R; 84/96

[58] Field of Search ..... 84/1.28, 94 R, 95 R, 84/96, 97, 99, 102, 103; 46/99

[56] References Cited

U.S. PATENT DOCUMENTS

| | | | |
|---|---|---|---|
| 1,626,275 | 4/1927 | Eckstein | 84/99 |
| 3,195,390 | 7/1965 | Glass et al. | 84/96 |
| 3,535,973 | 10/1970 | Rosen | 84/97 |
| 3,720,128 | 3/1973 | Frank | 84/94 |
| 4,071,364 | 1/1978 | Clark et al. | 84/96 |

*Primary Examiner*—J. V. Truhe
*Assistant Examiner*—Forester W. Isen
*Attorney, Agent, or Firm*—Maky, Renner, Otto & Boisselle

[57] ABSTRACT

A toy including a music playing device therein capable of playing various musics by exchanging a removable rotary means. The toy comprises a toy body, an electronic musical scale generating means having a sound selecting means corresponding to the sounds composing the musical scale, a speaker, a rotary means rotatably and removably mounted in the toy body, a mechanism for turning the rotary means, and a means for operating the sound selecting means provided on the surface of the rotary means. The electronic musical scale generating means is adapted to produce electrical signals of the sounds corresponding to the sound selecting means upon operating the sound selecting means. The rotary means is disposed adjacently to the sound selecting means so that the means for operating the sound selecting means may operate the sound selecting means to play a predetermined music as the rotary is rotated.

3 Claims, 16 Drawing Figures

TOY INCLUDING A MUSIC PLAYING DEVICE THEREIN

BACKGROUND OF THE INVENTION

This invention relates to a toy including a music playing device therein and, more particularly, to a toy in which a detachable rotator selectively operates an electronic music scale generator, so that a predetermined music may be automatically played.

There are already known prior art toys in which a music is played by a music playing device such as a musical box, a glockenspiel or a pipe included therein while travelling or conducting a music playing action. One problem encountered with such prior art toys is that they cannot play plural musics. A music playing device such as a musical box or the like included in such conventional toys is constructed in such a manner that a musical scale generating device is operated by protrusions provided on the peripheral surface of a rotator to thereby automatically play a music, however, the rotator is not exchangeable. Additionally, in such conventional toys, a rotator is formed by fixing metal protrusions for operating a music playing device onto a metal drum or by winding a metal strip provided thereon with metal protrusions round a metal drum; therefore, even if the rotator is exchangeable, such conventional toys are not suitable for children, particularly, for infants because there is a fear that they are injured by the metal projections or edges of the rotator. To avoid such disadvantages, it has been often intended to form a removable rotator by molding plastic. However, it is very difficult to integrally form a rotator having a plurality of protrusions radiately provided on the peripheral surface thereof by molding, because of the construction being complicated; accordingly, it is obliged to employ a complicated method including steps of separately forming a drum and protrusions and then fixing the latter onto the former. Still another problem encounted with such prior art toys is that a mechanism for playing a music is complicated.

The present invention eliminates the above mentioned problems of the prior art toys.

SUMMARY OF THE INVENTION

Accordingly, an object of the present invention is to provide a toy including a music playing device therein adapted to play various musics with a simple mechanism of operating switching means of an electronic music scale generator by means of a removable rotator.

Another object of the present invention is to provide a toy including a music playing device therein having a removable rotator adapted to be safe to handle and easy to manufacture, which is formed by stacking a plurality of circular members formed by molding plastic and integrally provided on the peripheral surfaces thereof with protrusions.

Still another object of the present invention is to provide a toy including a music playing device therein of exhibiting interests by the rotation of a rotator as well as by the play of a music, wherein a rotator has a head portion to imitate the head portion of an animal or the like.

According to the present invention, there is provided a toy including a music playing device therein comprising a toy body, an electronic musical scale generating means mounted in the toy body and having a sound selecting means corresponding to the sounds composing the musical scale, a speaker mounted in the toy body for regenerating the output of the musical scale generating means, a rotary means rotatably and detachably mounted in the toy body, a mechanism for rotating the rotary means by means of a motor, and a means for operating the sound selecting means provided on the surface of the rotary means. The musical scale generating means is adapted to produce electrical signals of the sounds corresponding to the sound selecting means upon actuating the sound selecting means. The rotary means is disposed adjacently to the sound selecting means so that the means for operating the sound selecting means may operate the sound selecting means to play a preselected music as the rotary means is rotated.

BRIEF DESCRIPTION OF THE DRAWINGS

Other and further objects, features and advantages of the present invention will be apparent from the following description taken in connection with the accompanying drawings in which.

DETAILED DESCRIPTION OF THE EMBODIMENTS

Figure 1:
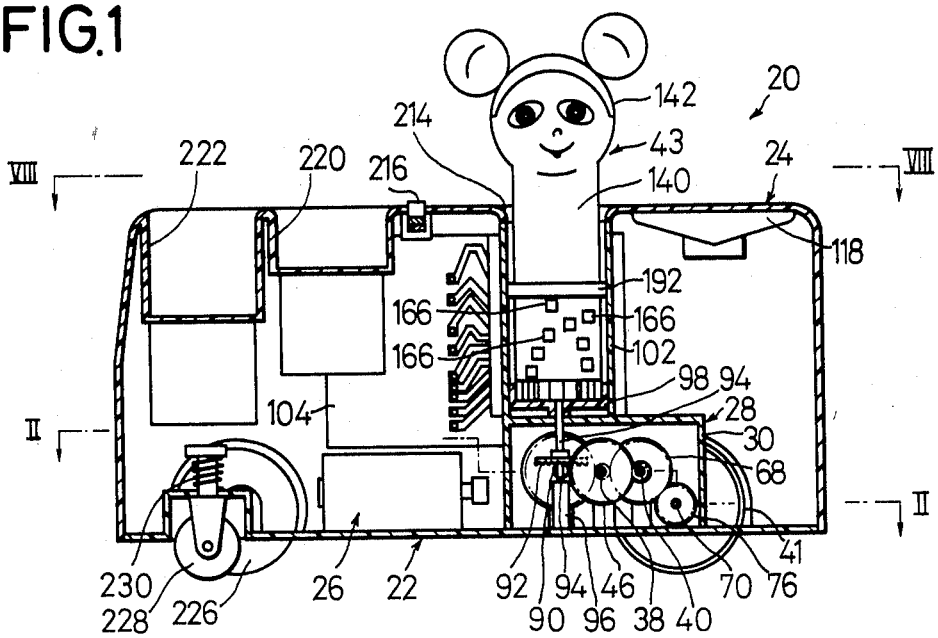
FIG. 1 is a vertical sectional view of a travelling toy according to an embodiment of the present invention.

Referring first to FIGS. 1 to 10 showing an embodiment of the present invention, reference numeral 20 designates a travelling toy body, which is formed of a bottom plate 22 and a box cover 24 mounted on the bottom plate 22. The bottom plate 22 is provided on the substantially central portion thereof with a power source 26 such as batteries and is provided theron a gear box 28 at the rear of the power source (right side in FIGS. 1 and 2). The gear box 28 is formed of a frame 30 fixed on the bottom plate 22, and a motor 32 having an output shaft 34 is disposed on the plate 22 adjacently to the gear box 28. The output shaft 34 extends through the frame 30 into the gear box 28 and is provided with a pinion 36 fixed at the end thereof. A main shaft 38, a shaft 40 for driving wheels 41 and a shaft 42 for a rotator 43 are beared by the gear box 28 in such a manner that the shafts are parallel to the output shaft 34. On the main shaft 38, a first gear means 44 integrally formed of a gear 46 and a pinion 48 is rotatably fitted in the vicinity of the one end thereof so that the gear 46 is engaged with the pinion 36. On the main shaft 38, a second gear means 50 is also fitted fixedly which is integrally formed of a gear 52 and a pinion 54 adjacently to the first gear means 44. The main shaft 38 is provided with a clutch 56 in the vicinity of the other end thereof, the clutch 56 comprising a pawl member 58 fixed on the main shaft 38 and a pawl member 60 rotatably fitted on the main shaft 38. The main shaft 38 is also provided with a third gear means 62 rotatably fitted thereon, the third gear means 62 being disposed on the end surface of the pawl member 60 oppositely to the second gear means 50. The main shaft 38 is also fitted thereon a coil spring 64 between the pinion 54 of the second gear means 50 and the third gear means 62 so as to press the movable pawl member 60 to the fixed pawl member 58. On the shaft 40 for the driving wheels 41, a fourth gear means 66 integrally formed of a gear 68 and a pinion 67 is rotatably fitted in such a manner that the gear 68 and pinion 67 are engaged with the pinion 48 of the first gear means 44 and gear 52 of the second gear means 50, respectively. The shaft 40 is also provided with a fifth gear means 68 fixed thereon adjacently to the fourth gear means 66 so that the fifth gear means is engaged with the pinion 54 of the second gear means 50. Reference numeral 70 designates a driving shaft beared by gear box 28 and it horizontally extends through the gear box 28. The driving shaft 70 is provided on the substantially central portion thereof with a flange 72 and is also provided with a pawl member 74 fixed thereon spacedly from the flange 72. The driving shaft 70 is also provided with a sixth gear means 76 integrally formed with a movable pawl member 78, the sixth gear means 76 being rotatably fitted on the shaft 70 in such a manner that the gear means 76 is slidable in the longitudinal direction of the shaft 70 and is engaged with the fifth gear means 68. The movable pawl member 78 constitutes a clutch 80 in cooperation with the fixed pawl member 74 and is constantly forced to the fixed pawl member 74 by a coil spring 82. When a load overcoming the force of the coil spring 82 is applied on the driving shaft 70, the movable pawl member 78 is disengaged from the fixed pawl member to cause the trasmission of driving force to the shaft 70 to be shut off. The driving shaft 70 is provided at the both ends thereof with driving wheels 41 having a non-slip rubber disposed on the periphery thereof.

Figure 3:
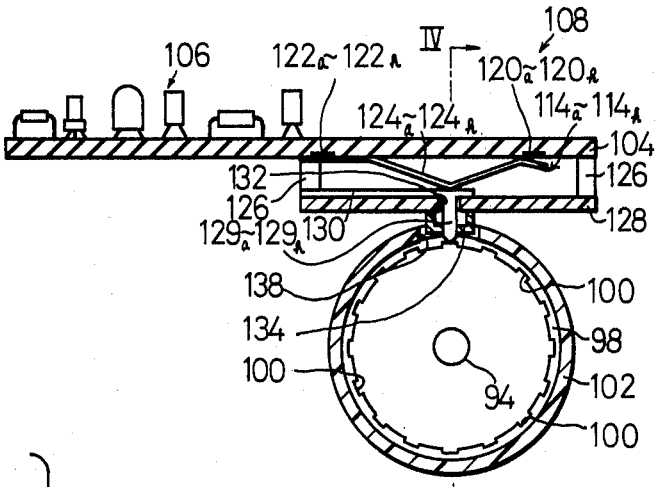
FIG. 3 is a horizontal sectional view showing the main portion of the toy shown in FIG. 1.
Figure 4:
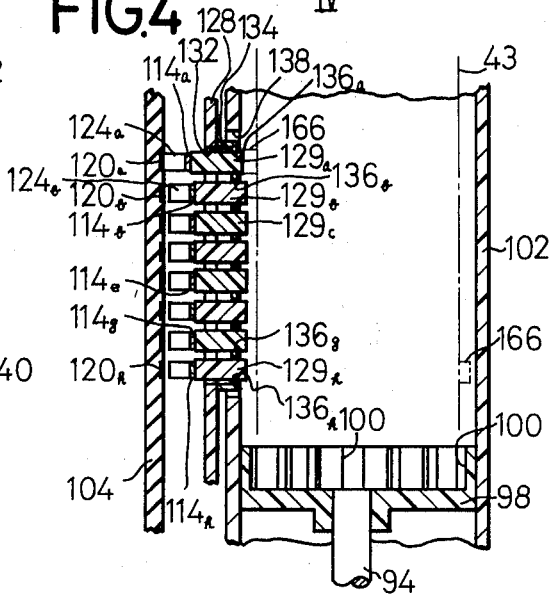
FIG. 4 is a sectional view taken along the line IV—IV in FIG. 3.

On the shaft 42 for the rotator 43, a seventh gear means 86 integrally formed of a gear 88 and a pinion 90 is fitted so that the gear 88 is engaged with the third gear means 62. The pinion 90 is adapted to be engaged with a crown gear 92 fixed on a vertical shaft 94 extending upwardly from the bottom plate 22 through the gear box 28. The vertical shaft 94 is rotatably supported at the lower portion thereof by a bearing member 96 and is beared at the vicinity of the upper end thereof by the gear box 28. The portion of the shaft 94 projecting upwardly from the gear box 28 is attached thereto a cylindrical member 98 for retaining the rotator 43, the retaining member 98 being provided on the inner peripheral wall with a plurality of recesses 100 extending upwardly, as shown in FIGS. 3 and 4. The retaining member 98 is loosely fitted into the lower end of a cylindrical member 102 fixedly disposed on the gear box 28 concentrically with the member 98. When a load over a predetermined level is applied to the retaining member 98, the clutch 56 acts in the same manner as the clutch 80 to cause the third gear means 62 to run idle on the main shaft 38.

Figure 2:
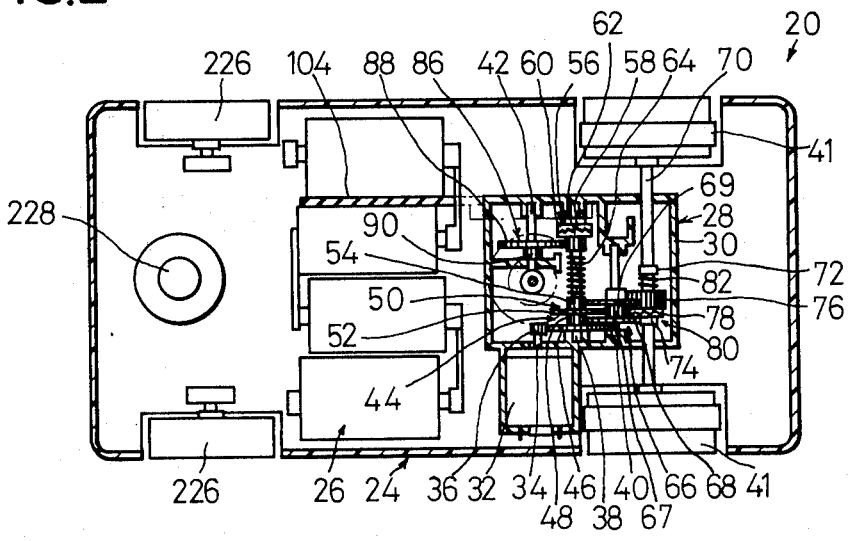
FIG. 2 is a sectional view taken along the line II—II in FIG. 1.
Figure 9:
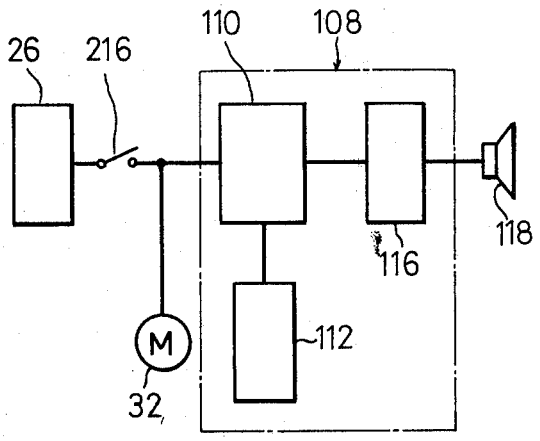
FIG. 9 is an electrical wiring diagram employed in the toy of FIG. 1.

The frame 30 of the gear box 28 is connected thereto a printed base plate 104 as shown in FIG. 2, on which electronic parts 106 such as a transistor, a diode, a resistor, a coil, a condenser and the like are attached which constitute an electronic device 108 for generating the musical scale, as shown in detail in FIG. 3. The electronic device 108 has switches corresponding to sounds composing the musical scale, so that it is adapted to produce an electric signal of the sound corresponding to each switch upon actuating the switch. For example, the device 108, as shown in FIG. 9, may consist of a sound source circuit 110 for producing an electric signal having a frequency corresponsing to each sound composing the musical scale; a keying circuit 112 which has switches 114*a* to 114*h* corresponding to the respective sounds and serves, upon operating each switch, to select the corresponding sound to the switch; and an amplifying circuit 116 which amplifies the signal selected by the keying circuit 112 to supply the amplified signal to a speaker 118. In the embodiment, as shown in FIG. 3, fixed contacts 120*a* to 120*h* of the switch 114*a* to 114*h* and terminals 122*a* to 122*h* connected to movable contactors 124*a* to 124*h* are printed on the back surface of the base plate 104. Each movable contactor 124 is formed by bending an electrically conductive strip into a substantially open V shape and is attached at the one end thereof to the corresponding terminal 122 by soldering. The other end of each contactor 124 is positioned in the vicinity of the corresponding fixed contact 120, so that the other end of each contactor contacts with the corresponding fixed contact to close the corresponding switch when pushing the bent portion of the contactor toward the printed base plate 104. To the back surface of the printed base plate 104 is also attached through spacers 126 a plate 128 for supporting switch knobs 129 so as to cover the movable contactors. Each leaf 130 is disposed between the supporting plate 128 and each movable contactor 124 in such a manner that it is fixed at the one end thereof between the plate 128 and the spacer 126 and is abutted at the other end thereof against the bent portion of the movable contactor. Each switch knob 129 is attached to the other end of each leaf so that the switch knob extends outwardly through each slit 132 bored through the supporting plate. The supporting plate 128 has a guide member 134 fixed on the outer surface thereof so as to cover the slits 132, the guide member 134, as shown in FIG. 4, being provided with guide holes 136*a* to 136*h* for passing the head portions of the switch knobs therethrough, respectively. The guide member 134 is fitted into a longtudinally extending slit 138 bored through the wall of the cylindrical member 102, and the head portion of each switch knob 129 projecting from the guide member 134 extends into the cylindrical member 102. The switch knobs 129*a* to 129*h* correspond to the respective sounds of an octave; and when pushing each switch knob, the sound corresponding to the knob is produced by the electronic device 108. In the embodiment, the number of switches, fixed contacts, movable contactors, terminals and switch knobs is eight so as to correspond to the sounds of an octave, however, such components may be provided as many as the sounds of two or more octaves.

Figure 5:
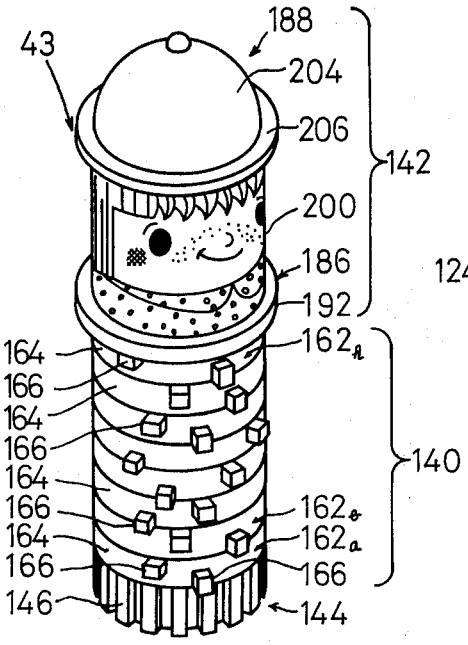
FIG. 5 is a perspective view of a rotator employed in the toy shown in FIG. 1.
Figure 6:
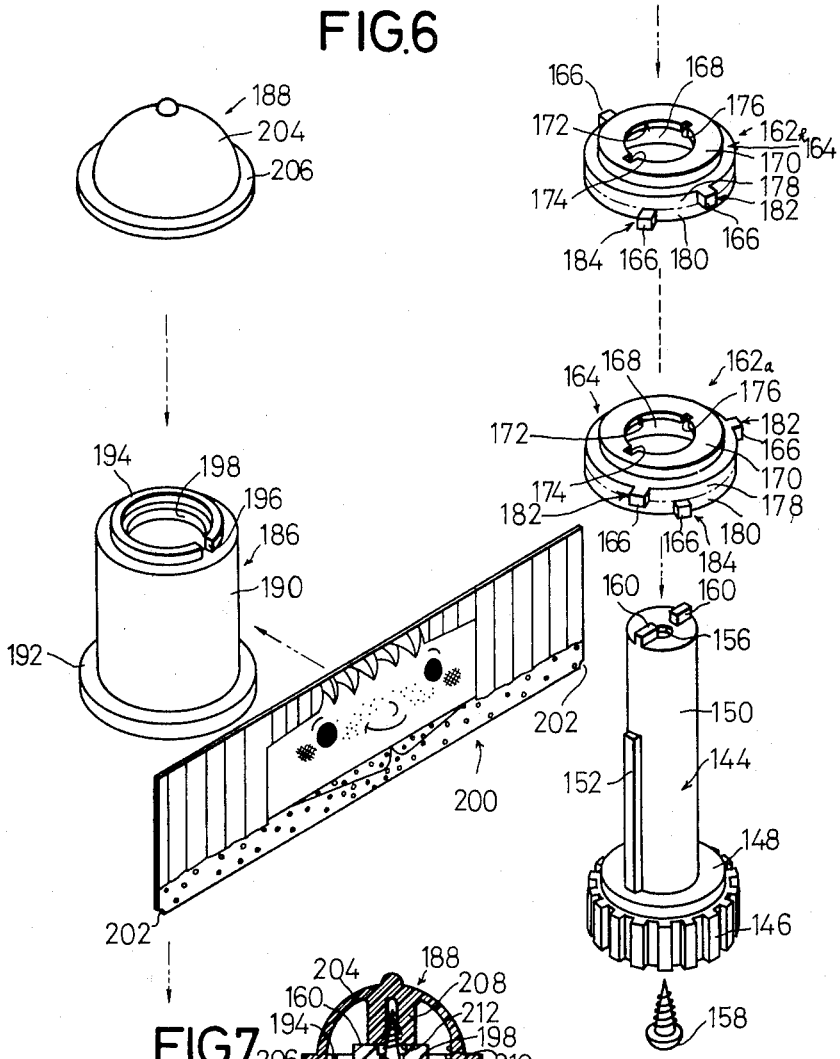
FIG. 6 is an exploded perspective view of the rotator shown in FIG. 5.
Figure 7:
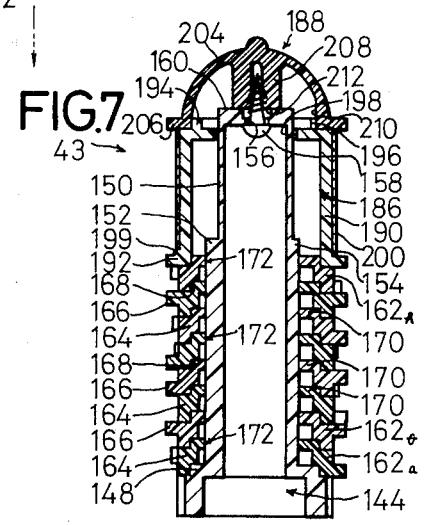
FIG. 7 is a vertical sectional view of the rotator shown in FIG. 5.

The rotator 43 is constructed in such a manner as shown in FIGS. 5 to 7 and is adapted to play a predetermined music by means of the electronic device 108 by selectively pushing the switch knobs 129*a* to 129*h*. The rotator consists of a drum portion 140 and a head portion 142. The drum portion 140 includes a hollow spline shaft 144 provided on the lower periphery thereof with teeth 146 to be engaged with the recesses 100 of the retaining member 98 respectively. The spline shaft 144, as shown in FIG. 6, is formed with a circular step 148 above the teeth, and the shaft portion 150 of the spline shaft extends upwardly from the circular step. The shaft portion 150 is provided on the peripheral surface thereof with longitudinally elongated projections 152 and 154 opposite to each other along the axial direction of the shaft portion, the projections 152 and 154 being formed so as to be different in width and length from each other. The hollow spline shaft 144 is integrally formed, and is opened at the lower end of the tooth portion and is closed at the top end of the shaft portion 150, as shown in FIG. 7. The top surface of the shaft portion 150, as shown in FIG. 6, is formed at the central portion thereof with a bore 156 for passing a screw 158 therethrough and is provided thereon with positioning guides 160 extending in the radial direction thereof, which are opposite to each other with the bore 156 interposed therebetween. Reference numerals 162*a* to 162*h* designate circular members integrally formed of plastic. Each circular member includes a circular portion 164 and protrusions 166 provided on the peripheral surface of the circular portion 164. The circular portion 164 is provided at the lower end thereof with a circular recess 168 of a size to be fitted on the circular step 148 of the spline shaft 144 and at the upper end thereof with a circular step 170 formed so as to have the same dimension as the circular step 148 of the spine shaft 144. The circular step 170 has an opening 172 adapted to be fitted on the shaft portion 150 and is provided on the inner surface thereof with recesses 174 and 176 engaged with the projections 152 and 154 of the shaft portion 150 respectively. The outer periphery of each circular member 162 is divided into a first area 178 and a second area 180 in the axial direction thereof. On the first and second areas are disposed a first protrusion group 182 and a second protrusion group 184 respectively, each protrusion group consisting of the plural protrusions 166 spaced from each other at predetermined intervals in the circumferential direction of the area correspondingly to a predetermined music to be played.

The circular members of such construction as mentioned above are mounted on the spline shaft in the following manner. Firstly, the circular member 162*a* of the lowermost position in FIG. 7 is fitted on the shaft portion 150 through the opening 172, is positioned circumferentially by engaging the recesses 174 and 176 with the projections 152 and 154 respectively, and then is securely mounted on the spline shaft 144 by fitting the circular recess 168 of the circular member 162*a* on the circular step 148 of the spline shaft 144; the circular member 162*b* is fitted on the shaft portion 150 and is positioned circumferentially in the same manner as the circular member 162*a*, and then is securely mounted on the spline shaft 144 by engaging the recess 168 with the circular step 170 of the circular member 162*a*; and the circular members 162*c* to 162*h* are mounted in turn on the spline shaft 144 in the same manner as the member 162*b*. Thus, the circular members 162*a* to 162*h* integrally stacked form the drum portion 140 in cooperation with the spline shaft 144. The first and second protrusion groups of the circular members 162*a* to 162*h* integrally stacked are disposed to be engaged with the switch knobs 129*a* to 129*h*, respectively. The circumferential length of each protrusion 166 is determined to correspond to the length of each sound required to play a predetermined music. The circular members illustrated in FIGS. 5 to 7 are eight in number correspondingly to the number of switches, fixed contacts, movable contactors, terminals and switch knobs; however, the switches and so forth may be sixteen in number so that each protrusion group pushes each switch knob, to thereby obtain a good sound effect. Further, the circular member may be four in number so that each protrusion group pushes each of the eight switch knobs, to thereby cause the construction of the rotator to be simple.

The head portion 142, as shown in FIG. 5, consists of a first head member 186 and a second head member 188. The first head member 186 is made of plastic; and includes a cylindrical portion 190 adapted to receive therein the circular step 170 of the uppermost circular member 162*h* and a flange portion 192 provided on the lower periphery of the cylindrical portion 190. The cylindrical portion 190 is provided on the upper end surface thereof with a circular projection 194 having a cutout 196, the circular projection being disposed concentrically with an opening 198 passing the shaft portion 150 of the spline shaft 144 therethrough. The border region between the cylindrical porton 190 and the flange portion 192 is formed at a portion thereof with a projection 199 for positioning a sheet 200, as shown in FIG. 7. On the sheet 200 is drawn a picture such as the face of an animal, a hero or heroine of a comic picture or the like. The sheet 200 is provided at the lower corners thereof with cutouts 202, as shown in FIG. 6. The sheet 200 is positioned on the periphery of the cylindrical portion 190 by engaging the cutouts 202 with the projection 199 and is adhered to the cylindrical portion 190 with a suitable adhesive means. The second head member 188 is also made of plastic and is illustrated as a hat in FIGS. 5 and 6. The hat 188 has a hemispherical portion 204 and a brim portion 206. The hemispherical portion 204, as shown in FIG. 7, has a pad 208 at the central portion of the inside thereof. The hat is provided on the inner surface thereof with a positioning guide 210, which is engaged with the cutout 196 of the circular projection 194 so that th circular projection 194 may be exactly fitted into the inside of the second head member 188 to thereby accomplish the secure engagement between the first and second head members. The pad 208, as shown in FIG. 7, is formed on the end surface thereof with a groove 212 in the substantially radial direction of the head member 188, the groove 212 being adapted to receive the guides 160 of the shaft portion 150 therein so as to prevent the hat 188 from rotating on the spline shaft. In addition, the screw 158 is inserted through the bore 156 of the shaft portion 150 into the pad 208 to fix the hat to the spline shaft 144, so that the circular members 162*a* to 162*h* and the first head member 186 are fixedly supported on the spline shaft 144 between the hat 188 and the circular step 148.

As mentioned above, the circular portion 164 of each circular member 162 is divided into the first and second areas in the axial direction so that the protrusion group is disposed on each area, however, each circular portion may be provided with only one row of projection group without dividing. The head portion consists of the first and second head members independent from each other, however, the both members may be integrally formed. The rotator is fitted into the retaining member in such a manner that the head portion protrudes from the box cover, so that the unique interest may be obtained by rotating the head portion during playing a music, however, the rotator may comprise only the drum portion.

The fixed mounting of the circular members on the spline shaft can be easily accomplished by stacking the circular members and by screwing, and the positioning of the protrusions can be easily achieved by engaging the recesses of the circular members with the projections of the spline shaft.

Certain marks such as serial numbers are preferably indicated on the circular members so that the stack of the circular members may be exactly and easily conducted.

As the rotator shown in FIGS. 5 to 7 is formed by stacking the circular members with the protrusions and each circular member is formed by molding plastic, the rotator is superior in safety to a conventional metal rotator because there is no fear that such sharp edges, corners and projections as the latter has appear on the surface of the former. Thus, the toy according to the present invention is suited to infants as well as children. In addition, as the rotator is exchangeable, the toy of the present invention can play many musics by exchanging the rotator.

Figure 8:
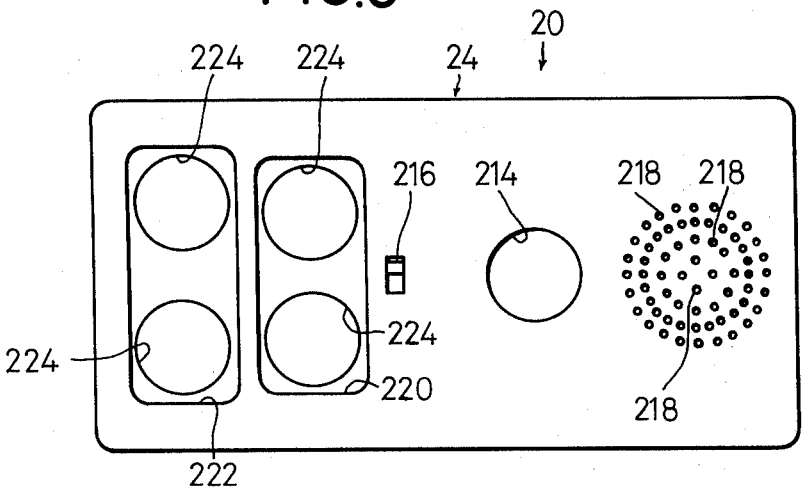
FIG. 8 is a plan view taken in the direction of the arrows substantially along the line VIII—VIII of FIG. 1.

The box cover 24, as shown in FIGS. 1 and 8, is formed on the top wall thereof with an opening 214 in alignment with the cylindrical member 102 so that the rotator 43 may be inserted into the cylindrical member 102. The cover 24 is provided on the top wall thereof with an electric power switch 216 adjacently to the opening 214, through which the output from the power source 26 is supplied to the electronic device 108 and the motor 32. The speaker 118 is attached on the inner surface of the rear top wall of the cover 24 to regenerate the output of the electronic device 108. A plurality of small holes 218 are bored through the top wall portion on which the speaker is attached, the holes 218 serving to diffuse outwardly the sound from speaker therethrough. The front portions of the top wall of the cover 24 are depressed to form substantially rectangular hollows 220 and 222. The bottom surface of each hollow is provided with recesses 224 having inner diameters suitable for loosely fitting therein spare rotators different in head shape and/or music to be played from each other, so that the spare rotators may be received therein.

Followers 226, as shown in FIGS. 1 and 2, are rotatably attached to the bottom plate 22 in the vicinity of the front end thereof, and a steering wheel 228 is attached to the bottom plate 22 between the both followers 162. The steering wheel 228 is supported on the bottom plate 222 in such a manner that it is movable in the vertical direction, and a spring 230 constantly forces the wheel 228 upwardly to limit the free rotation of the wheel 228. In addition, the wheel 228 is disposed so that the lower end thereof slightly projects below the lower end of each follower 226, whereby the toy body 20 is usually supported by the driving wheels 41 and the steering wheel 228 which form a triangle.

The operation of the toy mentioned above is conducted in the following manner.

Firstly, the rotator 43 is inserted through the opening 214 into the cylindrical member 102 so that the lower end of the rotator is fitted in the retaining member 98, and then the switch 216 is closed. When closing the switch 216, the motor 32 operates the driving wheels 41 to cause the toy body 20 to travel in the left direction in FIG. 1. The direction to which the body 20 travels is determined by the steering wheel 228 is desired. Simultaneously with the rotation of the driving wheels 41, the rotator retaining member 98 is rotated to cause the rotator 43 to be turned, so that the protrusions 166 on the periphery of the rotator 43 push in turns the switch knobs **129*a* to 129*h* to play a predetermined music through the device 108. As the rotator 43 has the head portion 142 projecting from the box cover 24, the turn of the rotator 43** causes the rotation of the head portion as well as the musical performance, thus, the toy according to the present invention causes interest to be doubled.

Figure 10:
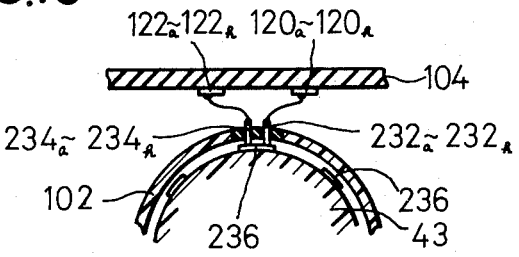
FIG. 10 is a sectional view of a modified form of the main portion of the toy shown in FIG. 1.

The embodiment as mentioned above employs the push button switches to select sounds which the electronic device produces, however, a sound selecting mechanism as shown in FIG. 10 may be employed. Pairs of electrodes **232*a*, 234*a* to 232*h*, 234*h* connected to the terminals 120*a*, 122*a* to 120*h*, 122*h* provided on the lower surface of the printed base plate are disposed to project inwardly from the cylindrical member 102, and the rotator 43 is provided on the outer periphery thereof with electrically conductive layers (switching means) 236** spaced from each other at predetermined intervals for short-circuiting the pairs of electrodes, whereby each pair of electrodes can be short-circuited by the electrically conductive layers as the rotator is turned.

Figure 11:
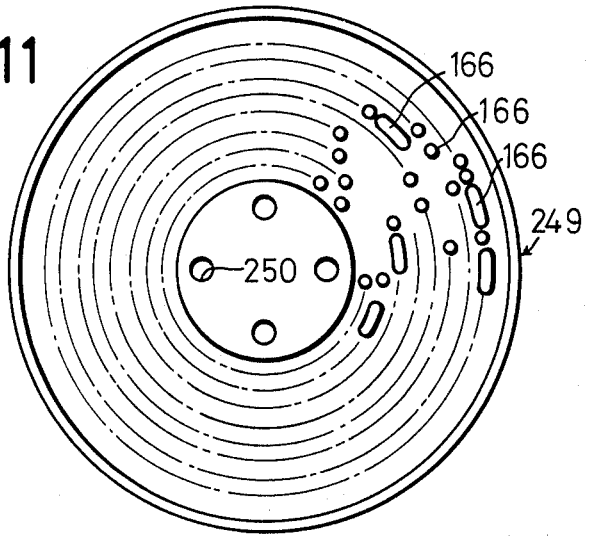
FIG. 11 is a plan view of a modified rotator employed in the present invention.
Figure 12:
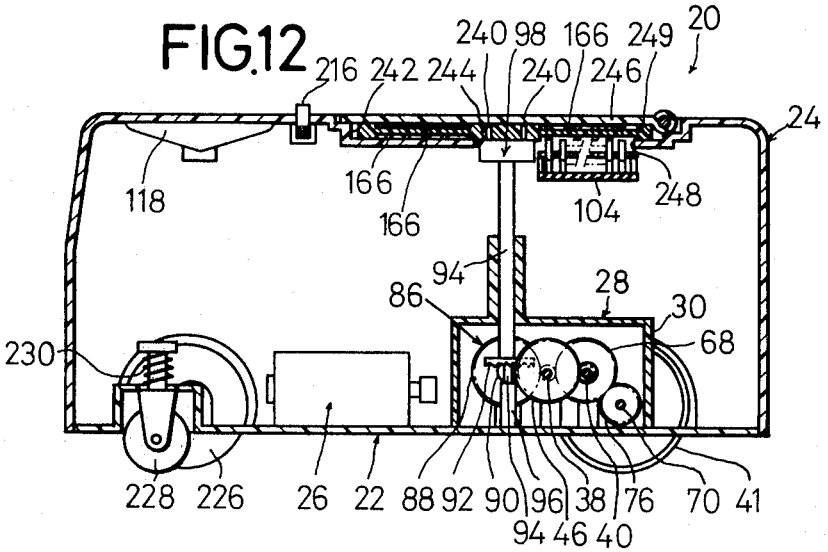
FIG. 12 is a vertical sectional view of a toy in which the rotator shown in FIG. 11 is adapted to be employed.
Figure 13:
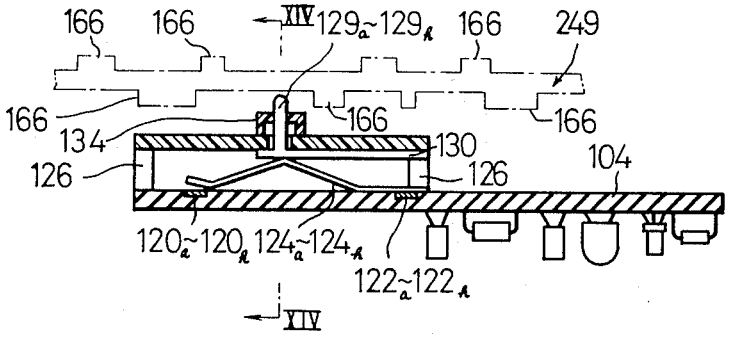
FIG. 13 is a vertical sectional view of the main portion of the toy shown in FIG. 12.
Figure 14:
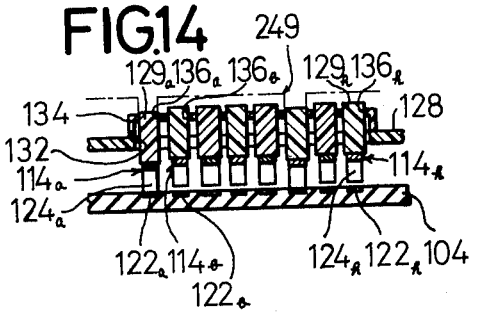
FIG. 14 is a sectional view taken along the line XIV—XIV in FIG. 13.

FIGS. 11 and 12 show a modified rotator 249 which is disc in shape and a toy body for rotatably receiving the disc rotator therein, respectively. The toy body is constructed in the substantially same manner as that shown in FIGS. 1 and 2 except the following. Therefore, like reference numerals designate like parts. A vertical shaft 94 extends upwardly through a gear box 28, and a disc rotator retaining member 98 having pins 240 projecting upwardly therefrom is attached to the upper portion of the vertical shaft 94. The top wal of a box cover 24 is depressed to form a circular recess 242 for rotatably receiving the disc rotator 249 therein, and the circular recess 242 is formed at the central portion thereof with an opening 244, in which the retaining member 98 is rotatably fitted. The pins 240 are disposed to project into the circular recess 242 when the retaining member 98 is fitted in the opening 244. A lid 246 covers the circular recess 242 which is hinged at the one end thereof to the box cover 24. The circular recess 242 is formed at the bottom portion thereof with a slit 248 extending in the radial direction, as shown in FIG. 12, and a printed base plate 104 is disposed below the slit 248, as shown in FIG. 14.

The disc rotator 249, as shown in FIG. 11, is formed at the central portion thereof with four holes 250, namely, two pairs of holes, the holes of each pair being opposite to each other. The disc rotator is securely fitted in the retaining member 98 by engaging any one pair of holes 250 with the pins 240 of the retaining member, so that the disc rotator may be turned together with the retaining member. The disc rotator 249 is provided on at least one surface thereof with a plurality of protrusions 166 to be selectively engaged with switch knobs **129*a* to 129*h*. The protrusions 166** are disposed at predetermined intervals in the radial direction of the disc rotator so as to correspond to the switch knobs. The number of rows of protrusions in the radial direction of the disc rotator and the number of protrusions in each row are predetermined dependently on a music to be played. The circumferential length of each protrusion is predetermined dependently on the length of each sound composing a predetermined music.

Figure 15:
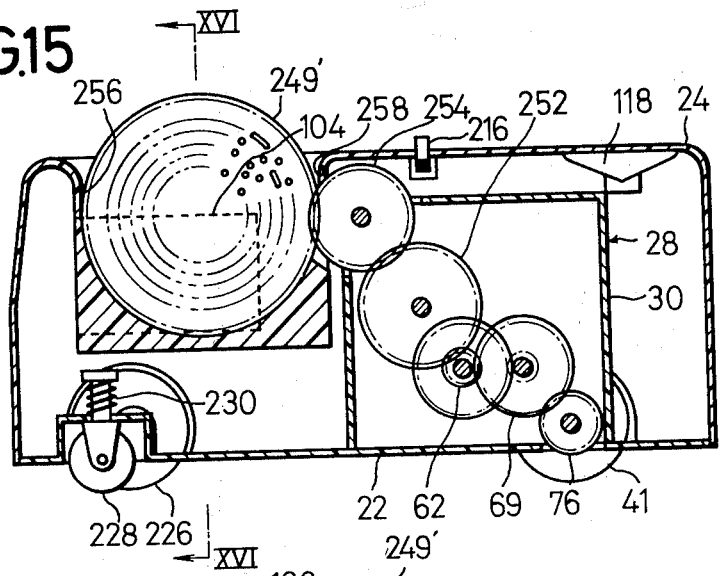
FIG. 15 is a vertical sectional view of a modified form of the toy of FIG. 12.
Figure 16:
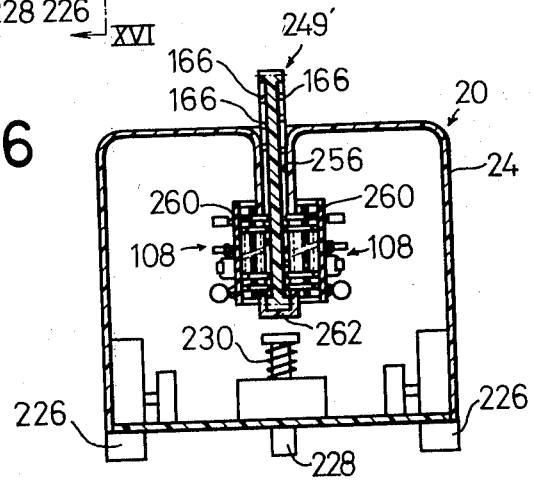
FIG. 16 is a sectional view taken along the line XVI—XVI in FIG. 15.

The disc rotator is horizontally fitted in the toy body, however, it may be vertically fitted as shown in FIG. 15. For this purpose, a toy body 20 somewhat different in construction from that of FIG. 12 is employed. A gear box 28 is formed somewhat larger. The gear box 28 receives first to sixth gear means similarly to the gear box of FIG. 12. A gear 252, which corresponds to the seventh gear 86 of FIG. 12, is disposed at a higher position in the gear box, which engages with a gear 254 disposed above the gear 252 so that a portion thereof projects from the gear box. The gear 254 is positioned at the substantially central portion of the toy body along the width direction of the toy body. The front portion of the top wall of a cover 24 is depressed in the longitudinal direction to form a recess 256 having a semicircular cross section. The recess 256, as shown in FIG. 16, is formed so that the side walls thereof extend in the vertically downward direction from the top wall of the cover 24. The recess 256, as shown in FIG. 15, is provided at the rear end surface thereof with an opening 258 for projecting a portion of the gear 254 therethrough into the recess 256. Each side wall of the recess 256 is provided at the central portion thereof with a vertically extending slit 260, and a row of movable contactors is disposed in each slit 260. A disc rotator 249' is inserted into the recess 256 which selectively pushes switch knobs to play a preselected music. The disc rotator 249' is different from the disc rotator 249 in that the former is formed on the end surface thereof with teeth 262 and is not formed at the central portion thereof with openings. When the disc rotator 249' is inserted into the recess 256, thhe tooth 262 engages with the tooth of the gear 254, to thereby transmit turning effect to the disc rotator 249'. A member 104 indicated by dotted line in FIG. 15 is a printed base plate.

In the toy body shown in FIGS. 15 and 16, two electronic devices are disposed to be simultaneously operated by the protrusions on the both surfaces of the disc rotator 249', so that the toy body may cause excellent sound effects. In addition, the disc rotator is removably mounted in the toy body, thus, many musics can be played by exchanging the disc rotator.

The disc rotator may be fitted in the toy body in such a manner that the rotator is perpendicular to the longitudinal direction of the toy body. In such case, it is required to change the driving force transmitting direction by using a crown gear, a bevel gear and the like so that the output gear means received in the gear box has shaft perpendicular to the driving shaft.

The embodiment has been described in connection with the travelling toy, however, those skilled in the art will appreciate a toy including a music playing device therein wherein a toy body is immovable and a musical performance is only conducted.

As many apparently widely different embodiments of the present invention may be made without departing from the spirit and scope thereof, it is to be understood that the invention is not limited to the specific embodiment thereof except as defined in the appended claims.

What is claimed is:

1. A toy incuding a music playing device therein comprising: a toy body; electronic musical scale generating means mounted in said toy body and including sound selecting means corresponding to the sounds composing the musical scale so as to produce electrical signals of the sounds corresponding to said sound selecting means; a speaker mounted in said toy body of regenerating the output of said musical scale generating means; rotary means rotatably mounted in said toy body; a mechanism for rotating said rotary means by means of a motor; protrusions provided on the surface of said rotary means which act to operate selectively said sound selecting means to play a predetermined music piece through said musical scale generating means as said rotary means is rotated; said rotary means including a cylindrical rotator formed by securely stacking a plurality of circular members in the axial direction thereof which is adapted to be detachably mounted in said toy body; said protrusions being provided on the peripheral surface of each of said circular members integrally with the circular member.

2. A toy including a music playing device therein as defined in claim 1, wherein said peripheral surface of each of said circular members is divided into two areas in the axial direction thereof, and said protrusions are provided on each of said areas so that each of said circular members may operate, respectively two of said sound selecting means.

3. A toy including a musical playing device therein as defined in claim 1, wherein said rotary means has a head portion integrally provided on said cylindrical rotator to project upwardly from said toy body.

* * * * *